US008939812B2

(12) United States Patent
Chan et al.

(10) Patent No.: US 8,939,812 B2
(45) Date of Patent: Jan. 27, 2015

(54) TWO-SIDED TOY VEHICLE

(75) Inventors: Albert Wai Tai Chan, Taipei (CN); Ka Hung (William) Ko, Hong Kong (CN)

(73) Assignee: Thinking Technology, Inc., Nassau (BS)

( * ) Notice: Subject to any disclaimer, the term of this patent is extended or adjusted under 35 U.S.C. 154(b) by 222 days.

(21) Appl. No.: 13/813,238

(22) PCT Filed: Jul. 29, 2011

(86) PCT No.: PCT/CA2011/000875

§ 371 (c)(1),
(2), (4) Date: Apr. 30, 2013

(87) PCT Pub. No.: WO2012/012889

PCT Pub. Date: Feb. 2, 2012

(65) Prior Publication Data

US 2013/0244536 A1 Sep. 19, 2013

Related U.S. Application Data

(60) Provisional application No. 61/502,050, filed on Jun. 28, 2011, provisional application No. 61/392,198, filed on Oct. 12, 2010, provisional application No. 61/388,307, filed on Sep. 30, 2010, provisional application No. 61/369,330, filed on Jul. 30, 2010.

(51) Int. Cl.

| | |
|---|---|
| ***A63H 30/04*** | (2006.01) |
| ***A63H 30/02*** | (2006.01) |
| ***A63H 17/00*** | (2006.01) |
| ***A63H 17/395*** | (2006.01) |

(52) U.S. Cl.

CPC ..... *A63H 30/02* (2013.01); *A63H 17/004* (2013.01); *A63H 17/395* (2013.01); *A63H 30/04* (2013.01)

USPC ..... 446/456; 446/454

(58) Field of Classification Search

USPC ..... 446/431, 436, 440, 454, 456, 468

See application file for complete search history.

(56) References Cited

U.S. PATENT DOCUMENTS

| | | | | |
|---|---|---|---|---|
| 4,300,308 | A * | 11/1981 | Ikeda | 446/457 |
| 4,969,851 | A | 11/1990 | Rasmussen | |
| 5,727,985 | A * | 3/1998 | George et al. | 446/437 |

(Continued)

FOREIGN PATENT DOCUMENTS

| | | | |
|---|---|---|---|
| CN | 2802620 | Y | 8/2006 |
| GB | 2214099 | A | 8/1989 |
| WO | 2009038797 | A2 | 3/2009 |

OTHER PUBLICATIONS

"International Search Report dated Nov. 4, 2011 for PCT/CA2011/000875, from which the instant application is based," 4 pgs.

(Continued)

*Primary Examiner* — Kurt Fernstrom

(74) *Attorney, Agent, or Firm* — Fredrikson & Byron, P.A.

(57) ABSTRACT

A slim, two-sided remote controlled toy vehicle with high speed, high maneuverability and high shock and crash resistance. A remote control scheme based on digital signals embedded in infrared beams allows improved control and high-speed terrestrial and aerial stunt capabilities. The toy intelligently implements infrared communication, on board micro-control units, flip sensors, sounds, lights and other pre-programmed actions. Various stunt accessories are also provided, to increase the play value of the toy.

24 Claims, 7 Drawing Sheets

(56) References Cited

U.S. PATENT DOCUMENTS

| | | | | |
|---|---|---|---|---|
| 5,803,790 | A * | 9/1998 | Tilbor et al. | 446/470 |
| 6,095,890 | A | 8/2000 | George et al. | |
| 7,147,535 | B2 | 12/2006 | Simeray | |
| 7,494,398 | B2 * | 2/2009 | Laurienzo | 446/454 |
| 8,038,504 | B1 * | 10/2011 | Wong | 446/454 |
| 8,365,848 | B2 * | 2/2013 | Won | 180/9.32 |
| 8,632,376 | B2 * | 1/2014 | Dooley et al. | 463/63 |
| 2005/0157668 | A1 * | 7/2005 | Sivan | 370/312 |
| 2007/0173171 | A1 | 7/2007 | Pal Benedek et al. | |
| 2007/0293124 | A1 * | 12/2007 | Smith et al. | 446/454 |
| 2008/0070472 | A1 | 3/2008 | Campbell | |
| 2010/0159800 | A1 | 6/2010 | O'Connor | |

OTHER PUBLICATIONS

"Written Opinion dated Nov. 4, 2011 for PCT/CA2011/000875, from which the instant application is based," 5 pgs.

"International Preliminary Report on Patentability dated Dec. 10, 2012 for PCT/CA2011/000875, from which the instant application is based," 9 pgs.

* cited by examiner

TWO-SIDED TOY VEHICLE

Related Applications

This application is a 35 U.S.C. 371 national stage filing from International Application No. PCT/CA2011/000875 filed Jul. 29, 2011 and claims priority to United States Provisional Patent Application Nos. 61/369,330 filed Jul. 30, 2010, 61/388,307 filed Sep. 30, 2010, 61/392,198 filed Oct. 12, 2010, and 61/502,050 filed Jun. 28, 2011, the teachings of all of which are incorporated herein by reference.

FIELD OF THE INVENTION

The present invention relates to motorized and remote controlled toy vehicles.

BACKGROUND OF THE INVENTION

Remotely controlled battery powered toy vehicles are generally well known. Also well known are many means of remote control for such motorized toys, both radio wave and infrared based.

Reversible or flippable toy cars are also known in the art. Such toy cars generally have open wheels (mounted laterally outside the chassis and uncovered by fenders) that are large enough to extend beyond the top of the car body, so as to support the car clear off the ground when flipped upside-down. The chassis may either have two distinct "car body appearances" on the two opposite sides, or it can be identical on both sides.

Also known are reversible or flippable toy cars that are capable of flipping themselves. For this purpose, some prior art toys use spring actuated levers that are released and hit the ground under the car (causing one end of the car to back-flip over the other end), while other prior art toys invert themselves by slowly climbing up with their front wheels on any vertical wall (under the propulsion of their rear wheels driven by high-torque motors) until their front end flips over backwards.

Also known in the art are toy ramps and tracks used in conjunction with toy cars. Ramps are typically used for jumps and rollovers, while tracks are used for creating loops and circuits.

Collimated optical or infrared (IR) beam remote control schemes for toys are also known in the art, generally involving a handheld remote control unit which emits a collimated optical and/or IR beam which projects a spot on the floor. The spot generated by this control indicates the area that the motorized toy must move towards. The vehicle detects, moves towards and reaches the spot projected on the ground from the remote control; if the user simply moves the spot of light to a succession of new positions to define the desired trajectory, the toy will follow such trajectory. U.S. Pat. No. 7,147,535 teaches an analog version of such control scheme, while U.S. Provisional Patent Application No. 61/369,330 (which shares the first named inventor with the present application) teaches a more sophisticated control scheme with digitally coded ID signals, discrete control channels, and the ability for the controlled toys themselves to control or interact with other motorized toys.

Such remote controlled motorized toys known in the art have certain limitations. In particular, the power to weight ratio for the available remote controlled toy vehicles is generally low by design, mainly due to the added weight of the onboard electrical batteries (typically the rechargeable type) and motors. Furthermore, particularly in small indoor environments typical of rooms in a house, users become quickly bored with the limited possibilities for play with such toy vehicles, which is often restricted to driving in endless loops, performing slaloms around objects and/or crashing and bumping into walls and furniture.

The prior art ramps and tracks also have limitations. In order to support and guide the toy cars and to be able to propel them in the air, such ramps and tracks must withstand significant impact forces and high levels of horizontal axis G-forces imparted by the cars travelling at high speed. Consequently, such ramps and tracks are built very sturdy and heavy, often with metal and other expensive components. Furthermore, in order to be self-standing and self-supported, such ramps and tracks require sizeable bases and large footprints, which adds bulk and causes difficulties in packaging such toys in retail boxes of reasonable sizes.

Prior art collimated infrared (IR) beam remote control schemes (that rely on a controlled vehicle tracking the IR light reflected from a target spot), while more intuitive and easier for younger users, are limited to relatively low speeds and only work when the target spot is kept within proximity of the moving vehicle. Even with the implementation of the best beam tracking methods known in the art, these remote controlled vehicles have major difficulties tracking a target IR spot that moves too fast; the frustrating result is that such vehicles will generally come to an abrupt stop whenever they cannot keep up with a fast moving IR target spot that gets so far ahead so as to exceed the detection range of the car's on-board IR sensors. This requirement to slow down the movement of the IR target spot (in order to maintain control) detracts from the play value of such toys, preventing them from performing more entertaining acts that require high speed.

Another shortcoming of prior art collimated infrared (IR) beam remote control schemes for motorized toys is the lack of a variable speed control mechanism implemented on the remote controller itself. The speed with which the car follows and approaches the moving IR target spot is, in the most current art, decided by the on-board micro control unit (MCU) based on the signals received from the on-board IR sensors. In the case of a fast moving IR target spot, the MCU will often command approach speeds that are inadequate: either too slow (resulting in the same lost signal problem discussed in the previous paragraph) or too fast (resulting in speeding through the target spot and overshooting it).

SUMMARY OF THE INVENTION

It is a major aspect of the present invention to provide an improvement to prior art remote controlled toy vehicles, by overcoming the above disadvantages through implementation of a toy vehicle with low weight, high speed, high maneuverability, flippability, intuitive remote control functionality, high shock and crash resistance, that enables spectacular terrestrial and aerial stunts from which the toy can recover without any user intervention.

It is a further aspect of the present invention to provide one or more full-size, thin and light-weight modular ramp accessories that increase the play value of the toy vehicle by enabling launches in the air and back-flipping effects. The ramp is easily assembled by even very young users and uses any commonly available vertical stable surface for lateral support (e.g. wall, furniture, stack of books, etc.). Its light weight and modular construction allows compact packaging in a reasonable size box appropriate for retail shelves.

It is a further aspect of the present invention to provide at least one bucket accessory that increases the play value of the toy vehicle. The user engages in a game of skill, aiming to launch the toy vehicle in the air (using the ramp accessory) so that it lands in the bucket. Due to the bucket's frusto-conical shape (increasing in diameter from its base to its top) any further acceleration imparted to the toy vehicle will cause the vehicle to engage in an ascendant spiral path on the bucket's wall, progressing from the base upwardly towards the top and ending with a spectacular launch on an outwardly trajectory out of the bucket.

It is a further aspect of the present invention to implement a manual variable speed control mechanism on the optical remote controller itself, so that the user can superimpose manual fine-control to the speed of the controlled vehicle, resulting in smoother, more accurate and more responsive target spot tracking.

According to a preferred embodiment, the invention includes a multifunction wireless remote controller and at least one controlled object. The wireless remote controller includes a micro control unit (MCU) that generates a digital identification (ID) coded signal which is then sent to an infrared (IR) transmitter. A beam of visible light is also projected from the wireless remote controller, in the same general direction of the emitted IR beam.

In a preferred embodiment, the controlled object is in the shape of a toy race car with a slim, light-weight body and large wheels. The toy car is able to roll on its wheels even when flipped over; its body is functionally double sided, so that it appears as two different cars depending on which side is facing up. The controlled object can include three or more on-board receivers (optoelectrical sensors) capable of receiving analog or digital ID coded infrared signals emitted from the wireless remote controller or from IR emitters placed on other compatible toys.

The on-board sensors transmit the received signal to one or more micro control units (MCUs) located on-board the controlled object. The on-board MCUs can optionally control one or more battery operated electrical motors or other propulsion means. Alternatively, analog control means can be employed in translating the signals received by the IR sensors into steering and propulsion for the controlled object.

The controlled object also includes an on-board level (flip) sensor that determines the flipped state of the car (detects which side of the car is facing up) and sends such information to the on-board MCU which may then control various sets of actions, sounds and lights, changing the personality of the toy car according to which side of the car is facing up. The on-board MCUs can also generate digital ID coded signals which are sent to one or more on-board infrared (IR) transmitters which can emit control signals for reception by other compatible toys.

In a preferred embodiment, there are two separate modes of remote control: the Light Guide mode and the Infrared mode. In the Light Guide mode, the wireless remote control scheme is built upon the collimated IR beam control scheme described in U.S. Provisional Patent Application No. 61/369,330, the entire teachings of which are hereby incorporated by reference. An improvement over the remote control scheme taught by the incorporated reference is the fact that the invention herein adds a manual variable speed control scheme to the remote controller itself, enabling the user to exert manual fine-control to the speed of the controlled vehicle.

Manual speed control is effected from the remote controller through the generation of distinct multiple "speed codes" for the digital control signal, with each "speed code" corresponding to a certain position of a trigger squeezed by the user. Depending of the "speed code" received from the remote, the MCU on-board the controlled vehicle will further adjust the speed relayed to the wheels in the performance of its regular target IR spot tracking duties.

In Infrared mode, the controlled vehicle does not attempt to track the target spot; instead, the controlled vehicle executes the intrinsic driving commands received from the remote via an omnidirectional (non-collimated) control signal. Infrared mode allows the vehicle to be controlled from the point of view of the vehicle's own instantaneous position (without reference to its surroundings) using directional commands such as "Forward", "Left", "Right", "Reverse", etc.

The Infrared mode allows the controlled vehicle to achieve much higher speeds compared to the Light Guide mode, at the cost of having the user perform actual directional driving from a "cockpit" point of view (instead of relaying on a sensor-and-MCU control scheme that automatically tracks the target spot in the Light Guide mode).

In a further preferred embodiment, the wireless remote controller is also fitted with an IR receiver connected to an MCU integrated into the control scheme, so as to allow a wide range of interaction, communication, handshake and feedback between the remote controller and one or more controlled objects via analog or digital ID coded IR signals.

BRIEF DESCRIPTION OF THE DRAWINGS

Other aspects and advantages of the invention will become apparent upon reading the detailed description and upon referring to the drawings in which.

Figure 1:
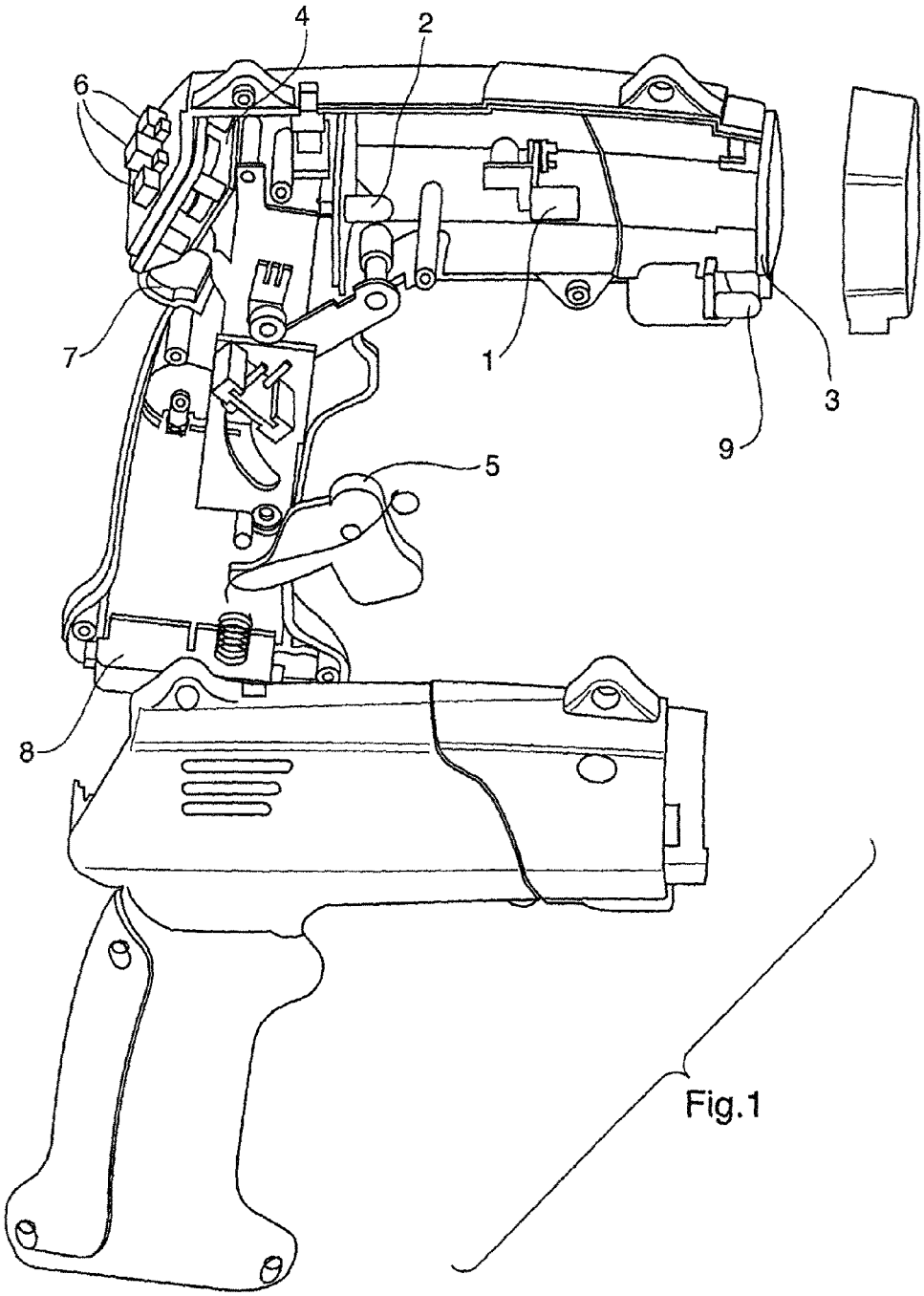
FIG. 1 shows a partially exploded view of the handheld Wireless Remote Controller in a preferred embodiment, in the shape of a typical handheld controller gun. The remote has.

- an internal Infra-Red emitter (1);
- a visible light source (LED emitter) (2);
- a Double Convex Collimation Lens (3) that converges the beam of the LED and the Infra-Red Emitter Lights, to project a collimated beam;
- a micro control unit (MCU) (4);
- a trigger (5) with on/off and manual speed control capabilities;
- "Left", "Right" and "Reverse" buttons (6) for manual directional control in Infrared Mode;
- a "Forward" (or "Turbo") button (7) for manual control in Infrared Mode;
- a battery compartment (8); and
- a non-collimated emitter (9), of a higher emitting power, placed on the exterior of the Remote Controller so as to afford a wider emitting angle and a longer range of reception for the controlled vehicle when used in the Infrared mode.

Figure 2:
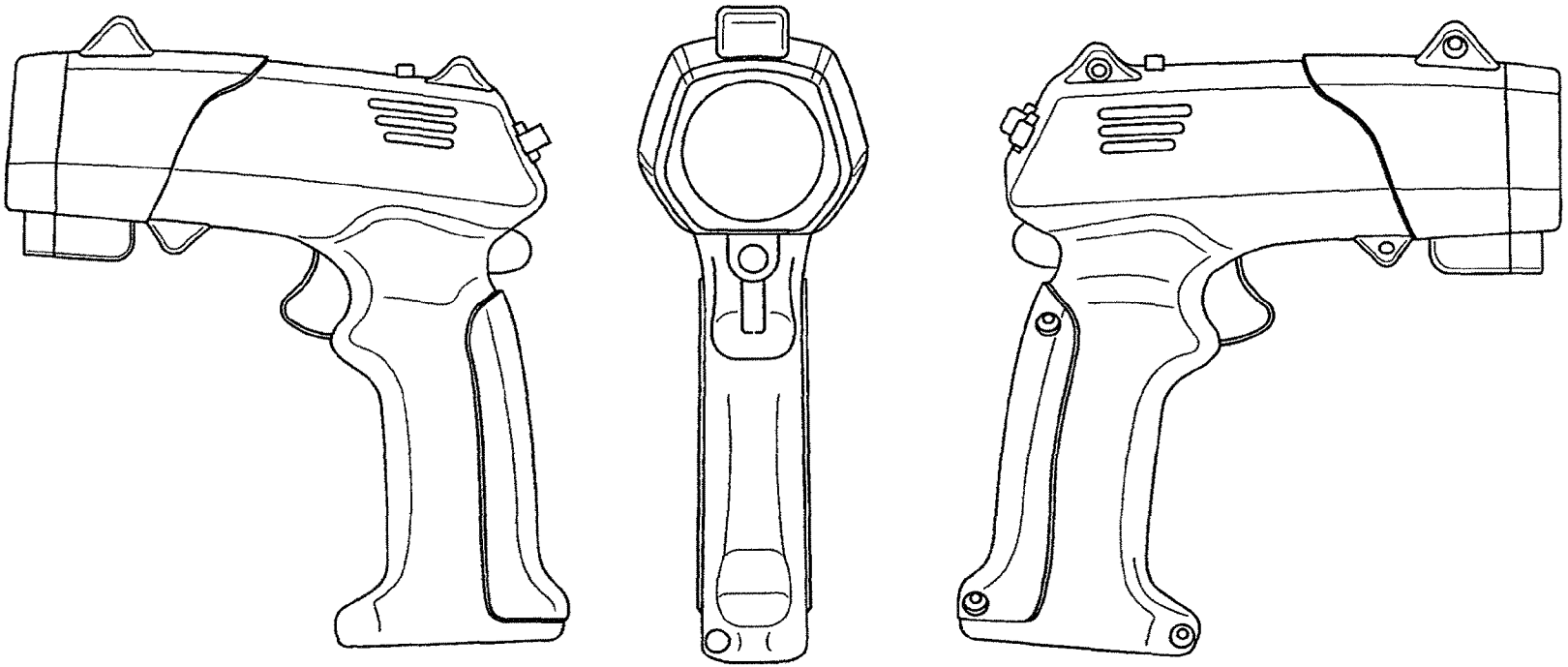

FIG. 2 is a drawing of a preferred embodiment of a Wireless Remote Controller showing left, front and right side views of the controller.

Figure 3:
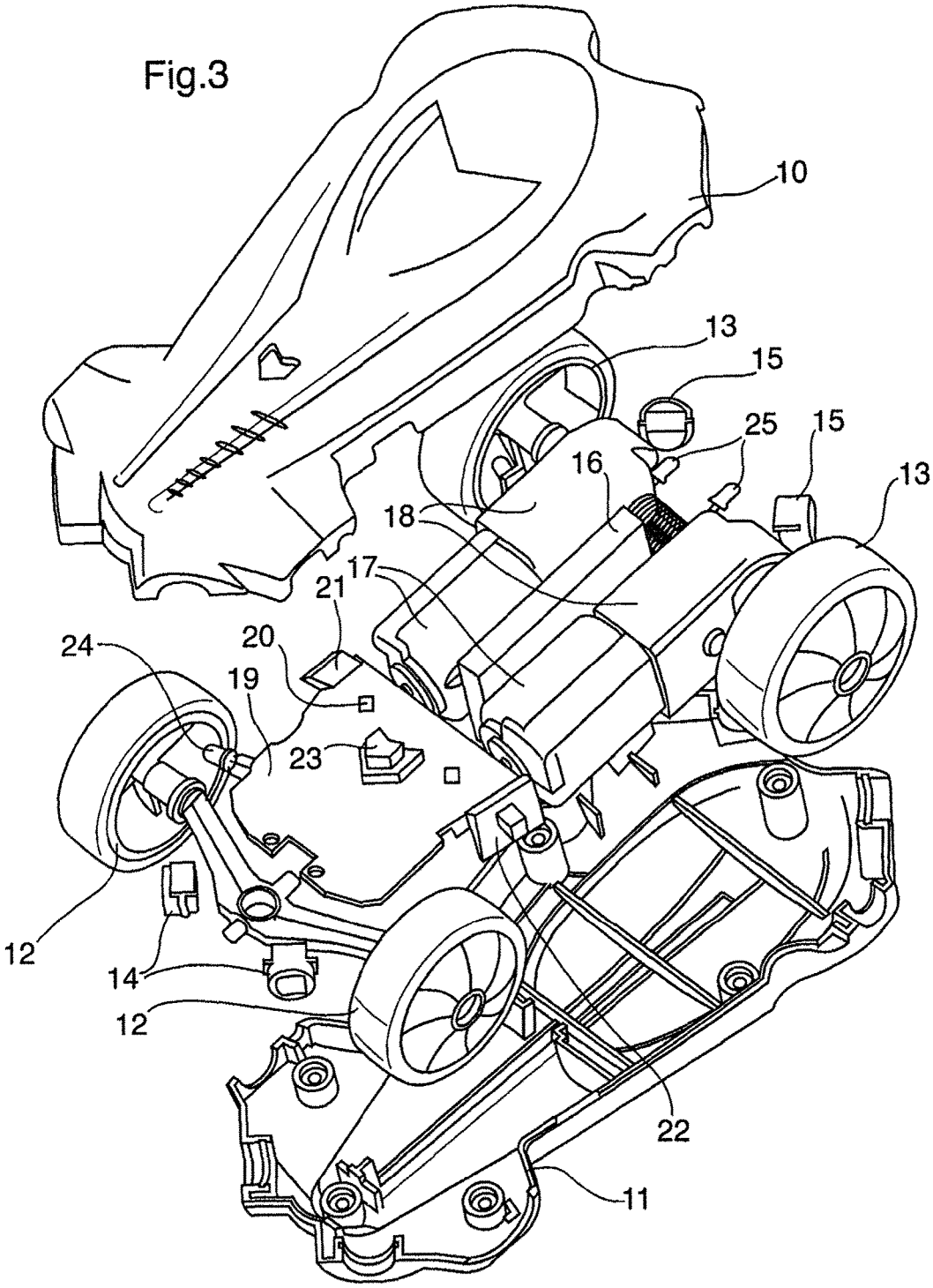

FIG. 3 is a partially exploded view of a preferred embodiment of the invention, comprising a controlled Moving Object in the shape of a race car. In FIG. 3, the car has:

- an upper body portion (10);
- a lower body portion (11);
- two front wheels (12);
- two rear wheels (13);
- two front IR receiving sensors (14);
- two rear IR receiving sensors (15);
- an autonomous source of energy (battery) (16);
- two independent electric motors (17) each separately driving one of the rear wheels via gearboxes (18);
- a micro control unit (MCU) (19);
- one or more flip sensor(s) (20);

charging port (21);

power on/off and channel selection switch (22);

"wake up" and/or "try me" button (23);

LED lights (24) positioned behind each wheel to create a coloured glow effect through the wheel's translucent rims; and optional onboard IR emitters (25) for downstream communication with other toys.

Figure 4:
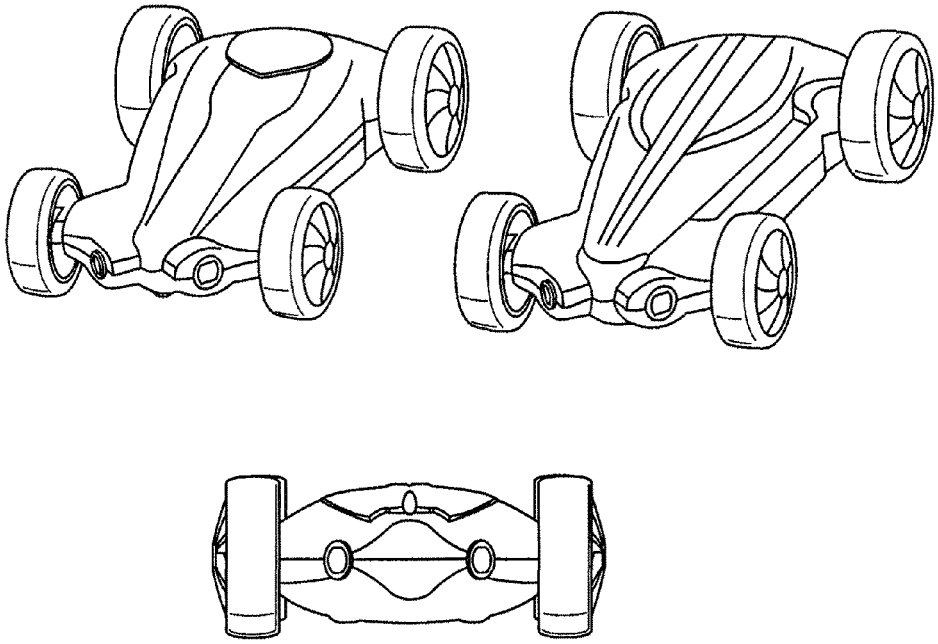

FIG. 4 is a view from the rear of a preferred embodiment of the invention in the shape of a race car, together with two perspective views of the car.

Figure 5:
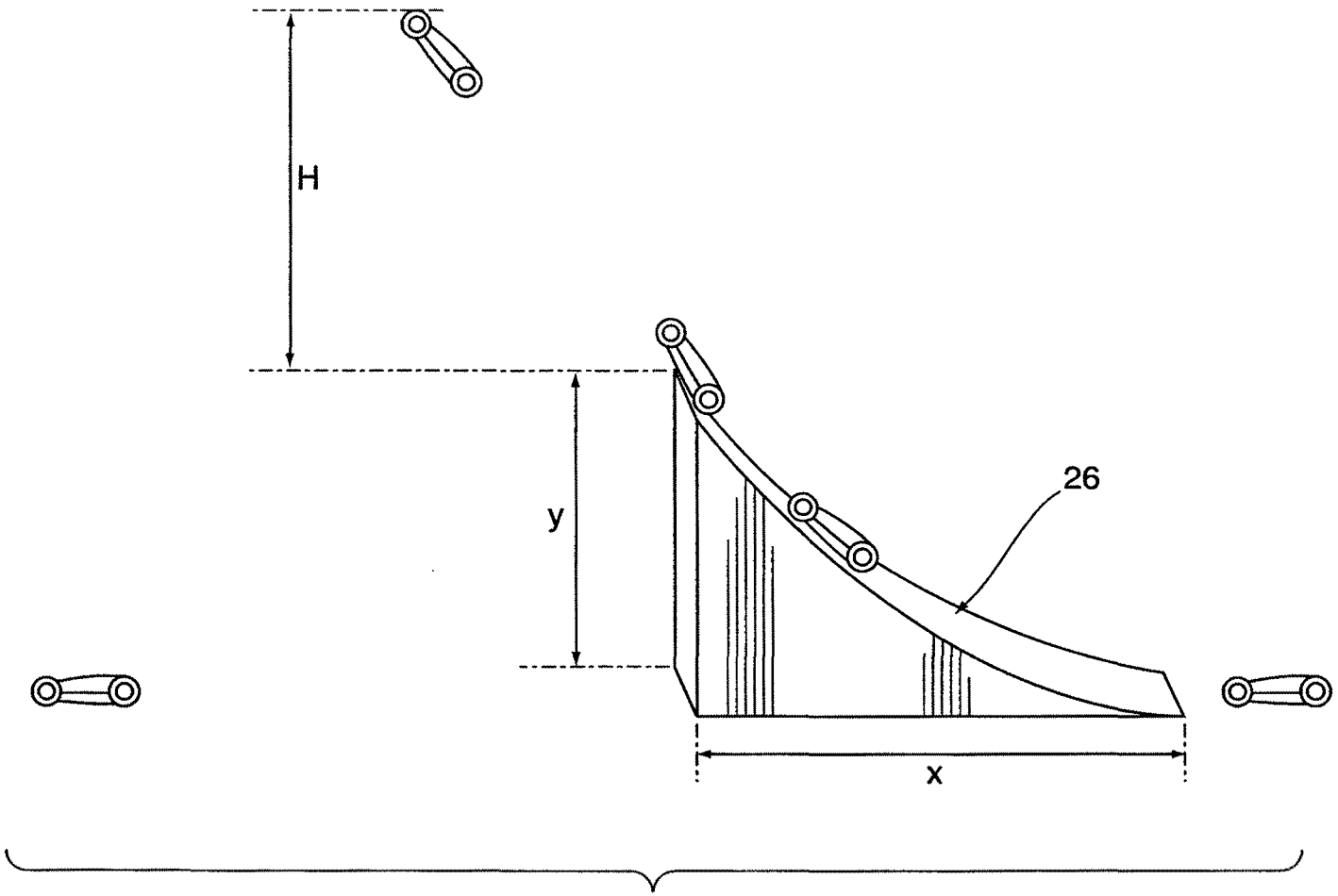

FIG. 5 is a schematic diagram of a setup using an alternative embodiment jump-ramp (26) to propel a toy car in the air. The height "H" of the jump varies with the speed of the car and with the length "x" and height "y" of the ramp.

Figure 6:
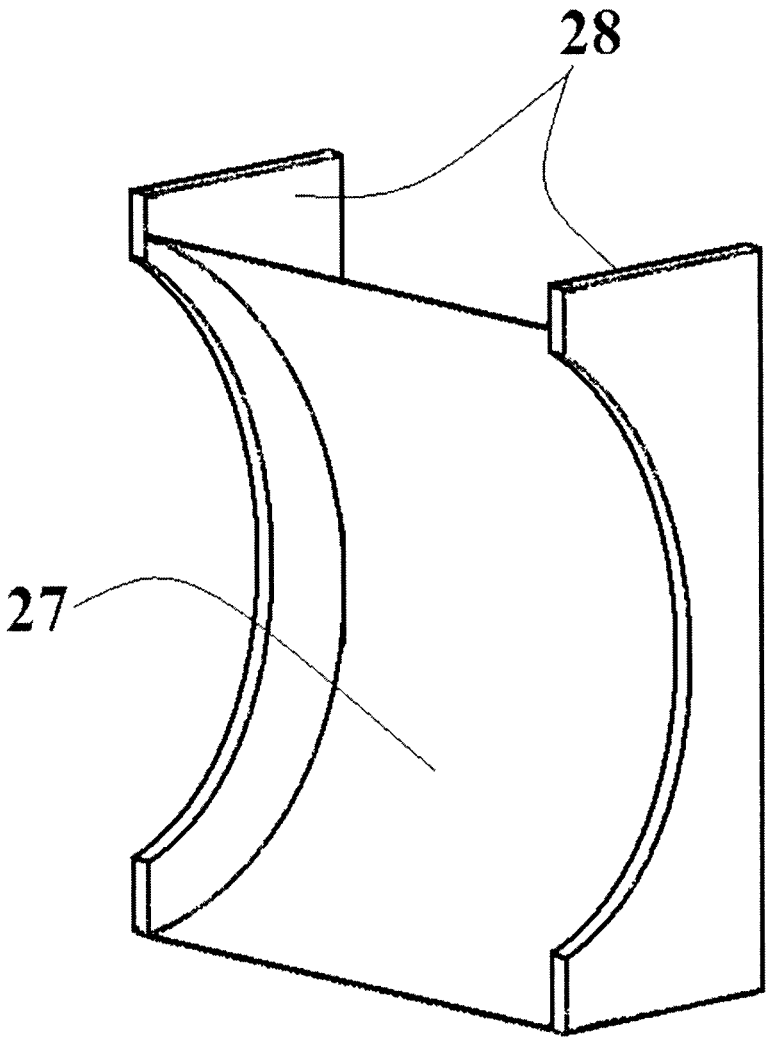

FIG. 6 is a drawing of a preferred embodiment of the ramp module of this invention, depicting a light-weight ramp designed to cause the car to fly in the air and flip over backwards. The ramp module consists of a rigid or flexible sheet of plastic (27) secured to a rigid frame (28) made of plastic, foam or cardboard. In the preferred embodiment, the frame of a module is reduced to only two lateral members, in between which the sheet of plastic is attached to form the running surface of the ramp. In use, this type of ramp needs to be supported against a stable vertical surface (e.g. wall).

Figure 7:
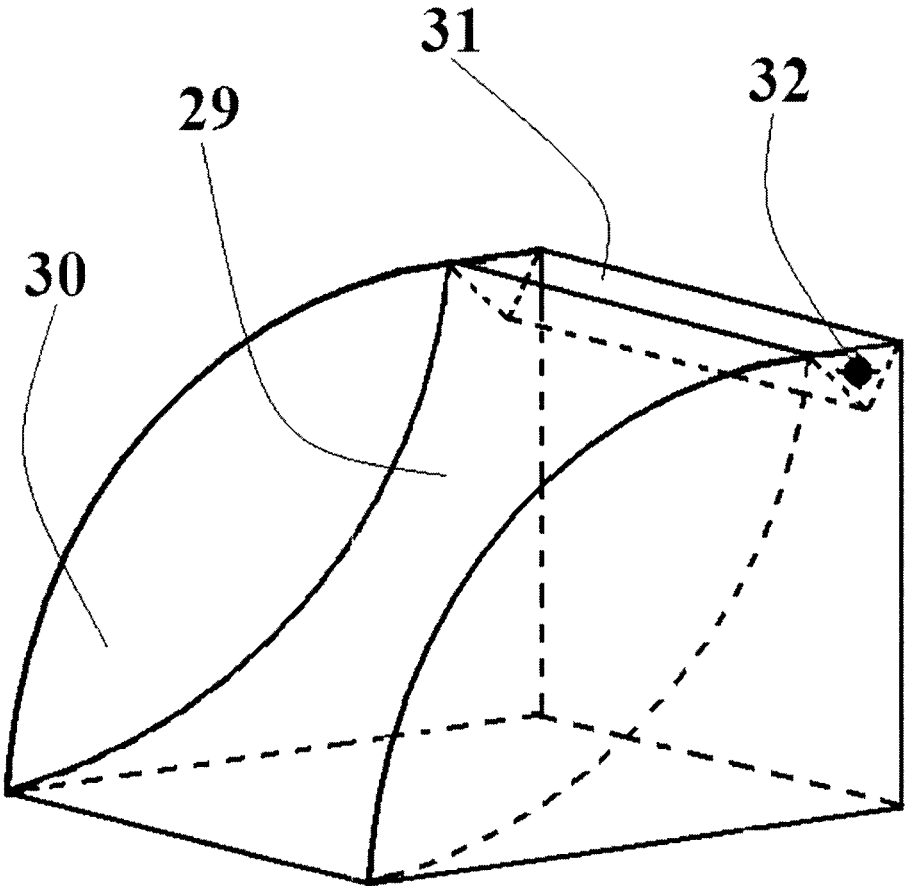

FIG. 7 is a drawing of another preferred embodiment of the ramp module of this invention, depicting an self-supported, adjustable-angle ramp designed to propel the car forward, upwards or to flip it backwards. The ramp module consists of a rigid or flexible sheet of plastic (29) secured to a rigid frame (30) made of cardboard folded into a stable, self-supported structure. A prismatic drum (31) can be rotated via a knob (32) to modify the angle of the upper lip of the running surface.

DETAILED DESCRIPTION OF PREFERRED EMBODIMENTS

Before explaining the present invention in detail, it is to be understood that the invention is not limited to the preferred embodiments contained herein. The invention is capable of other embodiments and of being practiced or carried out in a variety of ways. It is to be understood that the phraseology and terminology employed herein are for the purpose of description and not of limitation. For example, infrared optical signals and sensors are mentioned herein, however, any other suitable form of wireless data transmission and reception technology (e.g. radio waves, modulated visible light, lasers, etc.) could alternatively be employed for controlling the operation of the toy.

The wireless optical remote and the control scheme for a preferred embodiment of this invention are generally similar to the one described in U.S. Provisional Patent Application No. 61/369,330, the entire teachings of which are hereby incorporated by reference. When using the referenced control scheme, the preferred embodiment of this invention is said to be in Light Guide mode. When operating in Light Guide mode, the user projects and moves the IR target spot to the desired direction and the controlled vehicle attempts to track the movement of the IR target spot.

An improvement over the remote and the control scheme described in U.S. Provisional Patent Application No. 61/369,330 is the addition of a manual variable speed control scheme to the remote controller itself, enabling the user to exert manual fine-control to the speed of the controlled vehicle.

Manual speed control is effected from the remote controller through the generation of distinct multiple "speed codes" for the digital control signal, with each "speed code" corresponding to a certain position of a trigger squeezed by the user. In a preferred embodiment, this is achieved through the implementation of an additional digital ID code generating scheme controlled by a variable resistor that is itself controlled by the position of the trigger. However, any other known methods can be used to translate the degree of squeezing of the trigger into discrete "speed codes" that are subsequently embedded in the control signal sent to the controlled vehicle. Alternative embodiments further use "gear shifter" buttons or levers (placed on the remote controller) to allow for a wider range of manual speed control.

Depending of the "speed code" received from the remote, the MCU on-board the controlled vehicle will further adjust the speed relayed to the wheels in the performance of its regular target IR spot tracking duties. The user has a higher vantage point and thus has a better appreciation of the proper speed of approach that would produce optimal tracking of the target spot by the controlled car. When it appears that the controlled car is approaching the target at an excessive speed (a result of the on-board MCU overshooting in its speed control algorithm), a gentle release (ease up) on the remote control trigger by the user will manually cause a new "speed code" to be generated, which will force the on-board MCU to slow down the car. Should the user notice that the controlled car cannot keep up with a fast moving target spot (due to less optimal speed control by the on-board MCU) an extra squeeze of the remote control trigger will command an increase in speed to manually help achieve better tracking of a fast moving target.

In a further preferred embodiment, a switch on the remote controller is used to adjust the intensity of the control signals emitted in the Light Guide mode, so as to minimize reflection interference in the presence of highly reflective environments (e.g. shiny floors or walls).

A further improvement over the remote and the control scheme described in U.S. Provisional Patent Application No. 61/369,330 is the addition of a novel Infrared mode, implemented via one or more buttons placed on the remote controller. In contrast to the Light Guide mode (where the control signals are collimated into a beam so as to generate a "target spot" on the floor), in Infrared mode the remote controller sends non-collimated control signals, capable of being received by the on-board sensors of the controlled vehicle even when the remote controller is not pointed in the general direction of the controlled vehicle. In a preferred embodiment, the Infrared mode control signals are generated by a non-collimated second emitter, which is also of a higher emitting power, so as to afford a longer range of reception for the controlled vehicle.

When in Infrared mode, the remote controller commands the controlled vehicle to move in certain directions, such as "Forward", "Left", "Right", "Reverse", etc., as determined from the point of view of the vehicle's own instantaneous position (without reference to its surroundings). For example, in Infrared mode, the "Forward" command from the remote will cause the vehicle to move forward, irrespective of the relative position of the remote controller or the position of the target spot. Similarly, broadcasting the command "Left" from the remote controller, while in Infrared mode, will cause the controlled car to steer left.

In Infrared mode, the driving commands are preferably generated from dedicated "Forward", "Left", "Right", "Reverse" buttons placed on the remote; in alternative embodiments, the Infrared mode buttons can be replaced with other analog or digital controls, such as a steering wheel, joystick, etc. In a preferred Infrared mode embodiment, the remote controller implements two optional sub-modes: a "constant speed" Infrared mode, and a "variable speed" Infrared mode (where the latter mode allows the user to additionally engage the same manual speed control mechanism mentioned in paragraphs 34-36 above).

In a preferred embodiment, the Infrared mode actions are programmed to last for a short duration of time (several seconds or less), so as to prevent the car from straying away from the remote controller (by moving of the range of the remote when the user engages the Infrared mode in an open area). In one preferred embodiment, the Infrared mode allows just 1-2 meters of travel in one burst of high-speed, so that, at the end of the Infrared mode, the toy car is still within the operable distance range of the Light Guide mode of control and the user is still able to remotely turn the car around and bring it back to the original position. In other alternative embodiments, the user can disengage the Infrared mode by simply releasing the respective Infrared mode buttons.

In a preferred embodiment, the Infrared mode is used for spectacular stunt effects with the ramp accessory. The user will typically employ the Light Guide mode to position the controlled toy car directly facing the ramp, at a distance that will allow sufficient speed and/or momentum accumulation before engaging the ramp. Once the car is brought into the launch position with the Light Guide mode, the user switches to Infrared mode causing the car to surge forward at full speed, engage the ramp, be propelled in the air upon exiting the ramp, flip over and land with the other side of the car (the former bottom) facing up.

When the flipping stunt is properly timed, the Infrared mode will have expired by the time the car lands back on the ground and the motors will have been de-energized. However, should the Infrared mode not be expired by the time the car lands upside down, the onboard flip sensor will inform the MCU of the new, flipped position and the MCU will optionally reverse the direction of rotation of the car's rear wheels so as to ensure continuous forward movement for the car for the remainder of the Infrared mode time. Without this programmed change of wheel direction of rotation upon flipping, the car would reverse its direction of travel after each flip.

In a preferred embodiment of this invention, the ramp is modular and light-weight, as shown in FIGS. 6 and 7. It consists of two or more modules that are user-assembled before use. Each module consists preferably of a rigid or flexible sheet of plastic secured within a rigid frame made of plastic, foam or cardboard. In the preferred embodiment shown in FIG. 6, the frame of a module is reduced to only two lateral members, in between which a sheet of plastic is attached to form the running surface of the ramp.

The curvature of the sheet of plastic can follow various arcuate or flat angle profiles so that the assembly of two or more modules offers a generally continuous running surface for the toy car, extending upwards from the ground level. In the preferred embodiment shown in FIG. 6, the ramp profile is the typical "half pipe" that is conducive to spectacular back-flipping effects. However, various other ramp profiles can be used with a toy car in other embodiments, either as one module alone or through a combination of ramp modules with various arcuate or flat curvature profiles (e.g. ramps that propel the car straight up in the air, ramps with the launch angle optimized for either "long jumps" or "high-jumps", ramps that impart longitudinal rotation in addition to back-flipping, etc). For the preferred embodiment ramp depicted in FIG. 7, the launch angle of the running surface can be modified, via a knob (32), by rotating a prismatic drum (31) on which the upper portion of the running surface rests.

In a preferred embodiment, two or more ramp modules are assembled by partial edge overlap, however other embodiments can have various means of attachment between frames or lateral members of consecutive ramp modules. Alternatively, any other assembly method can be used to hold the ramp modules together.

In a preferred embodiment, the assembled ramp is meant to be positioned closely against a stable vertical surface (e.g. wall, large box, stack of books, etc.), relying on this vertical surface to provide the support required to withstand the large lateral G-forces inflicted upon the ramp by a fast moving car having its direction of travel suddenly changed.

As such, there is no need for the assembled ramp to be self-supporting or even self-standing, which dispenses with the need to use expensive or bulky structural components for the ramp. This affords economical construction of the ramp modules from inexpensive materials with less rigidity. The modularity of the ramp allows further savings by ensuring that the disassembled ramp fits inside a box of a reasonable size, via optimal nesting of the ramp modules and of the car within the same retail packaging box. Of course, if the situation warrants, heavier, more durable materials can be used.

In another preferred embodiment, the Infrared mode is used for further spectacular stunt effects in conjunction with a ramp accessory and a bucket accessory appropriately placed in relation to the ramp. Preferably, a self-supported "quarter-pipe" (such as the one depicted in FIG. 5), or a low-angle flat ramp is used instead of the half-pipe ramp described above, however highly skilled users can also use a half-pipe, back-flipping ramp for this purpose. The user engages in a game of skill, aiming to speed-launch the toy vehicle in the air (using the ramp accessory) so that it lands in the bucket. Due to the bucket's frusto-conical shape (increasing in diameter from its base to its top), engaging the Infrared mode while the toy vehicle is inside the bucket will cause the vehicle to engage at high speed in an ascendant spiral path on the bucket's wall, progressing from the base upwardly towards the top under the effect of centrifugal force, and ending with a spectacular launch on an outwardly trajectory out of the bucket. The bucket's wall is preferably made of a transparent plastic material so that the spiralling action of the vehicle racing up the wall may be viewed by the child playing with the toy thereby heightening the excitement and play value of the toy.

In the preferred embodiment of this invention shown in FIG. 3 and, the controlled object is a toy in the shape of a race car. As shown in FIG. 3, the car has one upper body portion (10) and one lower body portion (11); the two body portions are different in appearance, colour and decoration, so that the car assumes a new look and personality when flipped over. The upper and the lower body portions assembled together also form the rigid chassis of the vehicle.

In a preferred embodiment, only the two rear wheels (13) provide propulsion, while the steering is achieved by driving the left and right rear wheels at different rotational speeds. The wheel hubs, rims or hubcaps are preferably outwardly convex so as to prevent the car from ending on its side edge upon flipping and landing; due to the shape of the rims/hubcaps, the car will self-right itself on all four wheels after landing.

In a preferred embodiment, the car has four receiving IR sensors (12) and (13) located towards the corners of the chassis, a battery (16), two independent electric motors (17) each separately driving one of the rear wheels via gearboxes (18), a micro control unit MCU (19) and one or more level (flip) sensor(s) (20). The overall construction of the car is light-weight yet sturdy, so as to be able to withstand numerous repeated crashes, flips and hard landings. In a preferred embodiment, the car has no suspension and no articulations or steerable axles. In alternative embodiments, various other steering, suspension and drive-wheel configurations can be implemented (e.g. spring suspensions, steering by pivoting one or more axles, all-wheel drive, independently adjustable speed and direction of rotation for one or more wheels, etc.)

In a preferred embodiment, the wheels and/or the rims and/or the wheel hub covers are transparent or translucent and sources of light (24), such as LEDs of various colours, are placed on the chassis behind each wheel to create a coloured glow effect through the wheel. Various other lights, speakers and appendages can optionally be installed on each side of the car, controlled by the on-board MCU (19) to achieve distinct looks, sounds and personalities according to which side of the car is facing up.

In another preferred embodiment ("interactive mode"), more than one controlled moving objects can be played simultaneously, with an option to set up hierarchies among such controlled objects, namely one or more Master Moving Object and one or more Slave Moving Objects. The MCU of a Master Moving Object can optionally command its on-board IR transmitters (25 in FIG. 3) to emit its own IR control signals (analog or codified with an ID code corresponding to the Slave Moving Object), so that the IR emitters (25) of the Master Moving Object emit a target beam for the Slave Moving Object, similar to the "follow me" control mode described in U.S. Provisional Patent Application No. 61/369,330, the entire teachings of which are hereby incorporated by reference.

In a further preferred embodiment based on the "follow me" mode of controlling multiple moving objects described in U.S. Provisional Patent Application No. 61/369,330, the entire teachings of which are hereby incorporated by reference, the coloured light glow effect through the wheels, as well as other optional lights, sound effects, speakers and appendages, is controlled by the on-board MCU according to various pre-programmed parameters or according to signals received from on-board sensors, from other moving objects or from the remote controller. For example, the on-board MCU can control multi-colour LEDs (24) placed behind each individual wheel so as to vary or coordinate among multiple controlled toys, the coloured light glow effect through the wheels.

The combination of on-board receivers, MCUs and transmitters on the controlled toys also means that multiple such toys can control each other or otherwise interact, chase each other, fetch, bark, talk, communicate and handshake among themselves via omnidirectional, digital ID coded signals, without positional or angular restrictions.

The invention herein is capable of other embodiments and of being practiced or carried out in a variety of ways. For example, there can be multiple remote controllers and multiple Slave Moving Objects, and multiple Master Moving Objects. Another possibility is for means to switch among digital ID codes on the remote controller, selecting different Moving Objects as Masters or Slaves.

It is similarly to be understood that the phraseology and terminology employed herein are for the purpose of description and not of limitation. For example, any car, toy, object or Moving Object mentioned herein can alternatively be a truck, hovercraft, robot, vehicle, boat, plane, helicopter, doll, dog, animal or anthropomorphic character, etc. Alternatively, the remote control functionality can be fitted to any kind of hand-held, mobile or stationary object, (e.g. stick, helicopter, car, etc.). Alternatively, the Master Moving Object and the Slave Moving Object can each be from a different category mentioned above (e.g. a car could be the Master Moving Object while a helicopter could be the Slave Moving Object, etc.).

While the method of tracking a moving target based on the variable strength of the IR signal emitted or reflected from a beam projecting a target spot is used in the examples herein, any other beam tracking methods known in the art (based on light, radio waves, lasers, modulated visible light, etc.) could be used by the on-board sensors and MCUs to achieve the tracking functions described herein. Similarly, the "follow me" mode of operation between Master Moving Objects and Slave Moving Objects could be implemented by the use of fewer or more numerous transmitters and sensors on the Masters or Slaves, or by any other tracking methods known in the art.

What is claimed is:

1. A toy comprising:

a remote controller comprising:

a first optical emitter controlled by a control unit and configured to emit a digitally modulated optical beam containing digital identification codes, said remote controller configured with a lens of collimation that focuses said digitally modulated optical beam from said first optical emitter to generate a target spot on a surface;

a second optical emitter controlled by said control unit and configured to emit a modulated optical signal; and an infrared control scheme wherein said remote controller is further configured to send said digitally modulated optical signal to an on-board digital control unit of at least one controllable moveable object regardless of an angular position of said target spot relative to said at least one controllable moving object;

the at least one controllable moving object, having a chassis including a first side of said chassis and a second side of said chassis opposite said first side of said chassis, said chassis having a chassis plane and a maximum height dimension in a direction perpendicular to said chassis plane;

four wheels rotatably mounted relative to said chassis, each of said wheels having a diameter that is larger than said maximum height dimension of said chassis;

a flip sensor configured to generate a flip signal based on which of said first or second side of said chassis faces upward;

a plurality of optoelectronic sensors configured to receive the digitally modulated optical signals containing digital identification codes;

at least one on-board digital control unit that receives, from said plurality of optoelectronic sensors, electrical signals containing the digital identification codes;

propulsion and steering means controlled by said on-board digital control unit;

wherein said on-board digital control unit computes distance to and angular position of said target spot relative to said controllable moving object, based on said electrical signals received from said plurality of optoelectronic sensors;

wherein said on-board digital control unit controls said propulsion and steering means so that said controllable moving object is set in motion, follows and approaches said target spot on said surface;

wherein said modulated optical signal causes the on-board digital control unit of the at least one controllable moveable object to control said propulsion and steering means on said at least one controllable moving object, wherein said on-board digital control unit controls a direction of rotation of said wheels based on said flip signal received from said flip sensor; and wherein said at least one controllable moving object is capable of being operable on said wheels when either of said first or second side of said chassis faces upward.

2. The toy according to claim 1, further comprising a manual variable speed control scheme wherein said remote controller further comprises a trigger unit with two or more speed positions, said trigger unit generating digital speed codes modulated into said digitally modulated optical beam causing said on-board digital control unit to further control said propulsion and steering means according to said two or more speed positions of said trigger unit.

3. The toy according to claim 2 wherein said at least one controllable moving object further comprises a light effects system comprising light emitting means located on said at least one controllable moving object and controlled by said on-board digital control unit.

4. The toy according to claim 3, further comprising a modular ramp accessory, wherein said modular ramp accessory comprises two or more ramp modules.

5. The toy according to claim 4, further comprising a receiving means that is freely moveable with respect to said modular ramp accessory, said receiving means comprising an upwardly facing receiving cavity adapted to receive said at least one moving object launched from said modular ramp accessory and wherein said upwardly facing receiving cavity is of a generally frusto-conical shape having a lateral surface, a base and a top, and increasing in diameter from said base to said top.

6. The toy according to claim 2, further comprising a modular ramp accessory, wherein said modular ramp accessory comprises two or more ramp modules.

7. The toy according to claim 6, wherein each of said two or more ramp modules further comprise two or more lateral support members supporting a smooth central segment, wherein the smooth central segment of each of said two or more ramp modules partly overlaps with the smooth central segment of an adjacent ramp module to form a smooth, upwardly open, continuous curved surface having an upper edge and a lower edge, said lower edge adapted to be placed flush adjacent to a supporting surface with said upper edge being spaced from the supporting surface.

8. The toy according to claim 7, further comprising a receiving means that is freely moveable with respect to said modular ramp accessory, said receiving means comprising an upwardly facing receiving cavity adapted to receive said at least one moving object launched from said modular ramp accessory.

9. The toy according to claim 8, wherein said upwardly facing receiving cavity is of a generally frusto-conical shape having a lateral surface, a base and a top, and increasing in diameter from said base to said top.

10. The toy according to claims 1 wherein said at least one controllable moving object further comprises a light effects system comprising light emitting means located on said at least one controllable moving object and controlled by said on-board digital control unit.

11. The toy according to claim 10 wherein at least one of said light emitting means is located between said chassis and at least one of said wheels.

12. The toy according to claim 11, wherein at least one of said wheels comprises a light diffusing translucent portion so that said light emitting means direct light outwardly through said translucent portion of said wheel.

13. The toy according to claim 10, further comprising a modular ramp accessory, wherein said modular ramp accessory comprises two or more ramp modules.

14. The toy according to claim 13, further comprising a receiving means that is freely moveable with respect to said modular ramp accessory, said receiving means comprising an upwardly facing receiving cavity adapted to receive said at least one moving object launched from said modular ramp accessory and wherein said upwardly facing receiving cavity is of a generally frusto-conical shape having a lateral surface, a base and a top, and increasing in diameter from said base to said top.

15. The toy according to claim 1, further comprising a modular ramp accessory.

16. The toy according to claim 15, wherein said modular ramp accessory further comprises two or more ramp modules.

17. The toy according to claim 16, wherein each of said two or more ramp modules further comprise two or more lateral support members supporting a smooth central segment.

18. The toy according to claim 17, wherein the smooth central segment of each of said two or more ramp modules partly overlaps with the smooth central segment of an adjacent ramp module to form a smooth, upwardly open, continuous curved surface having an upper edge and a lower edge, said lower edge adapted to be placed flush adjacent to a supporting surface with said upper edge being spaced from the supporting surface.

19. The toy according to claim 18, wherein the smooth, upwardly open, continuous curved surface is suitable for accepting and directing said at least one controllable moving object upwards, causing said controllable moving object to inertially fly exteriorly and off the modular ramp accessory.

20. The toy according to claim 15, wherein said modular ramp accessory is used in conjunction with a vertical support surface abutting against said two or more lateral support members and preventing movement of said two or more support members.

21. The toy according claim 15, further comprising a receiving means that is freely moveable with respect to said modular ramp accessory, said receiving means comprising an upwardly facing receiving cavity adapted to receive said at least one moving object launched from said modular ramp accessory.

22. The toy according to claim 21, wherein said upwardly facing receiving cavity is of a generally frusto-conical shape having a lateral surface, a base and a top, and increasing in diameter from said base to said top.

23. The toy according to claim 22, wherein said at least one controllable moving object, when set in forward motion within said receiving cavity, may engage said lateral surface and move in an ascendant spiral path progressing from the base upwardly.

24. The toy according to claim 23, wherein said lateral surface is transparent.

* * * * *